US006731243B2

(12) United States Patent
Taira et al.

(10) Patent No.: US 6,731,243 B2
(45) Date of Patent: May 4, 2004

(54) PLANAR ANTENNA DEVICE

(75) Inventors: Ryuichi Taira, Kawasaki (JP); Shigeru Uchino, Yokohama (JP); Moriyoshi Kawasaki, Yokohama (JP); Yuji Maeda, Tokyo (JP)

(73) Assignee: Harada Industry Co., Ltd (JP)

( * ) Notice: Subject to any disclaimer, the term of this patent is extended or adjusted under 35 U.S.C. 154(b) by 0 days.

(21) Appl. No.: 09/736,752

(22) Filed: Dec. 14, 2000

(65) Prior Publication Data

US 2002/0036589 A1 Mar. 28, 2002

(30) Foreign Application Priority Data

Sep. 26, 2000 (JP) ..... 2000-292298

(51) Int. Cl.[7] ..... H01Q 1/38
(52) U.S. Cl. ..... 343/700 MS; 343/789
(58) Field of Search ..... 343/700 MS, 789, 343/718, 841; H01Q 1/38

(56) References Cited

U.S. PATENT DOCUMENTS

| | | | | |
|---|---|---|---|---|
| 4,131,894 A | | 12/1978 | Schiavone | |
| 4,197,545 A | * | 4/1980 | Favaloro et al. | 343/700 MS |
| 4,242,685 A | * | 12/1980 | Sanford | 343/700 MS |
| 5,608,263 A | | 3/1997 | Drayton et al. | 257/728 |
| 6,049,309 A | | 4/2000 | Timoshin et al. | 343/700 MS |

FOREIGN PATENT DOCUMENTS

| | | |
|---|---|---|
| EP | 0 996 192 A2 | 4/2000 |
| GB | 2054275 A | 2/1981 |
| JP | 05129823 | 5/1993 |
| KR | 1995-3960 | 12/1994 |
| KR | 2000-11121 | 2/2000 |

OTHER PUBLICATIONS

Notification for Filing Opinion for Korean App. No. 10–2000–0081709 (Korean, with English translation).

N. Karmakar & M. Singh, Investigations into a Circular Patch Antenna in a Cylindrical Cavity Enclosure, pp. 446–450, Proc. Singapore ICCS '94.

S.T. Jellett & M.E. Bialkowski, The Design of a Shielded, Dual Patch Antenna Array Element for Mobile Satellite Communications, pp. 140–143, Int'l Symp. Antenna and Propagation Soc'y 1993.

European Search Report for EP 00 31 1294, mailed Jan. 13, 2003.

* cited by examiner

*Primary Examiner*—Michael C. Wimer
(74) *Attorney, Agent, or Firm*—Dickstein Shapiro Morin & Oshinsky

(57) ABSTRACT

A planar antenna device comprises a ground plane, a planar antenna element having a principal plane mounted above the ground plane, and a cavity, having an opening partially exposing the antenna element, placed on the ground plane in order to cover the entire antenna element contactlessly.

35 Claims, 6 Drawing Sheets

PLANAR ANTENNA DEVICE

CROSS-REFERENCE TO RELATED APPLICATIONS

This application is based upon and claims the benefit of priority from the prior Japanese Patent Application No. 2000-292298, filed Sep. 26, 2000, the entire contents of which are incorporated herein by reference.

BACKGROUND OF THE INVENTION

The present invention relates to an on-vehicle planar antenna device for receiving satellite broadcasting.

Conventionally, there has been no technique but decreasing an antenna element size when a planar antenna device is used for obtaining high electromagnetic field radiation characteristics within the range of a wide elevation angle.

FIG. 1 illustrates a structure of a general air patch antenna device. FIG. 1 shows a ground plane 11, an antenna element 12 mounted on the ground plane 11 separated by a spacer 13, and a feed point 14 to the antenna element 12.

A microstrip antenna device stationed in the air ($\epsilon r=1$) has a high relative antenna device gain. On the other hand, however, the half-power angle generally becomes approximately 60° to 80° depending on antenna device shapes. Consequently, a gain remarkably decreases toward a low elevation angle.

To decrease the antenna element size for widening such a narrow elevation angle range, a dielectric must be used.

FIG. 2 illustrates an example structure of a dielectric patch antenna device using the dielectric. FIG. 2 shows a ground plane 21, a dielectric plate 22 mounted on the ground plane 21, an antenna element 23 provided on the dielectric plate 22, and a feed point 24 to the antenna element 23.

The size of the antenna element 23 is decreased by using the dielectric plate 22. It becomes possible to obtain high electromagnetic field radiation characteristics within a wide elevation angle range.

However, the antenna element size is decreased for the dielectric patch antenna device in FIG. 2. Compared to the air patch antenna device in FIG. 1, the antenna device gain greatly decreases. In addition, a loss due to the dielectric plate 22 further decreases the antenna device gain. As a result, the dielectric patch antenna device in FIG. 2 does not provide so high a radiation level toward a low elevation angle.

BRIEF SUMMARY OF THE INVENTION

An object of the present invention is to provide a planar antenna device which satisfies both of electromagnetic field radiation characteristics over a wide elevation angle range including a low elevation angle direction and a high antenna device gain.

A planar antenna device according to the present invention comprises: a ground plane; a planar antenna element having a principal plane mounted above the ground plane; and a cavity, having an opening partially exposing the antenna element, placed on the ground plane in order to cover the entire antenna element contactlessly.

Preferred manners for the above-mentioned planar antenna device are as follows.

(1) A feed point for supplying power supply to the antenna element is further provided.

(2) An area of the opening is smaller than a size of the antenna element.

(3) The opening is placed substantially parallel to a principal plane of the antenna element.

(4) The antenna element is an air patch antenna element mounted above the ground plane separated by a spacer.

Another planar antenna device according to the present invention comprises a ground plane; a planar antenna element having a principal plane mounted above the ground plane; and a planar conductor placed substantially parallel to a principal plane of the antenna element and having an opening at substantially a center thereof.

According to the present invention, it is possible to provide excellent electromagnetic field radiation characteristics over a wide elevation angle range including a low elevation angle direction and a high antenna device gain only by adding a cavity to a conventional air patch antenna device without decreasing the antenna element size, thereby maintaining sufficiently high antenna device gain.

Further, the present invention eliminates the need to use a dielectric for obtaining a gain toward a low elevation angle. It is possible to maintain a high antenna device gain without decreasing an antenna device gain due to a dielectric loss.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the planar antenna device according to the present invention will be described in further detail with reference to the accompanying drawings.

Figure 3:
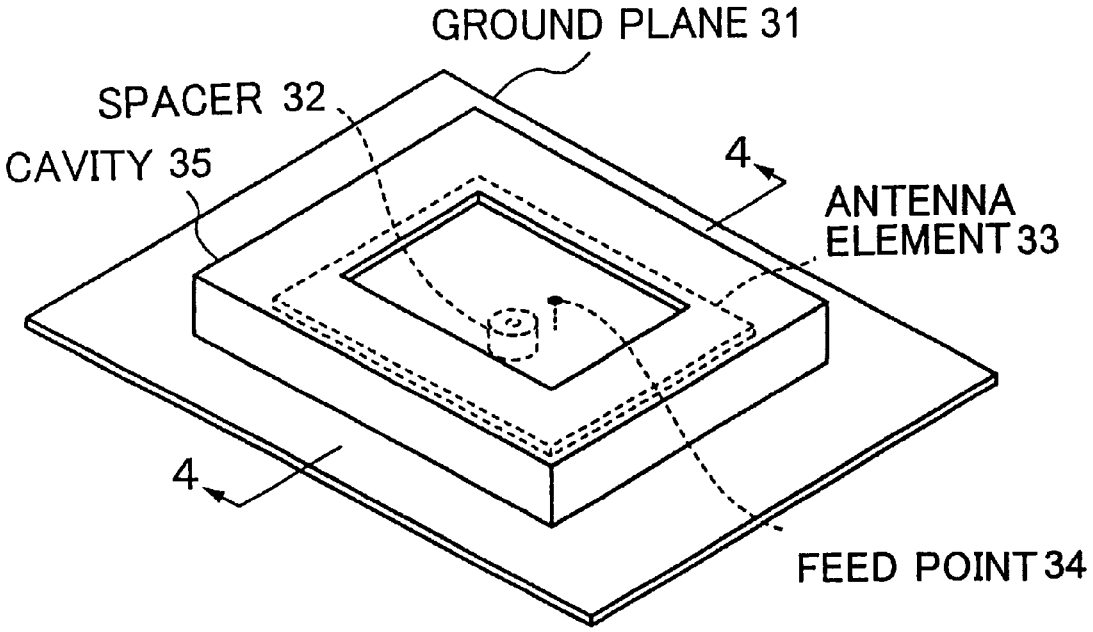
FIG. 3 is a perspective view illustrating a structure of an antenna device according to an embodiment of the present invention for receiving BS digital broadcasting.
Figure 4:
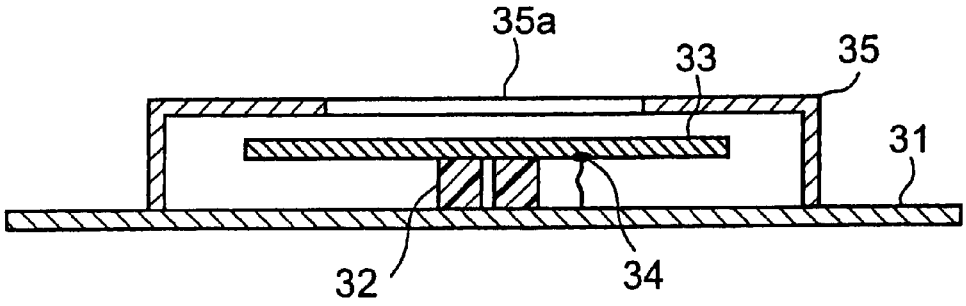
FIG. 4 is a sectional view of an antenna device structure taken along the line 4—4 of FIG. 3.

FIG. 3 is a perspective view illustrating a structure of a planar antenna device according to the present invention. FIG. 4 is a sectional view taken along the line 4—4 of FIG. 3.

In FIG. 3, an antenna element 33 is mounted above a ground plane 31 via a spacer 32 so that the antenna element 33 is separated from the ground plane 31. This antenna element 33 is excited by power from the feed point 34. The ground plane 31 is made of a metal plate such as brass, aluminum, stainless steel, and the like. The spacer 32 is made of synthetic resin such as polyacetal, polycarbonate, ABS, and the like. The antenna element 33 is made of a metal plate such as brass, aluminum, and the like.

A box-like cavity 35 is placed on the ground plane 31 so as to cover the entire antenna element 33. The cavity 35 is made of a metal plate such as brass, aluminum, and the like.

The cavity 35 is provided so that it does not touch the antenna element 33 with a predetermined distance. A square opening 35*a*, which is smaller than a size of the antenna element 33, is formed at a surface a cavity 35 which is opposite to the antenna element 33.

The opening 35*a* of this cavity 35 is formed in order to provide high electromagnetic field radiation characteristics in a wide range of elevation angles, especially toward a low elevation angle without reducing the size of the antenna element 33. It is possible to change electromagnetic field radiation characteristics especially toward a low elevation angle by adjusting the size of the opening 35*a* with reference to the antenna element 33 and a distance between the opening 35*a* and the antenna element 33.

In the above-mentioned antenna device structure, various characteristics observed from experiments will be described as follows.

First, characteristics of the antenna device itself will be described with reference to FIGS. 6 through 7.

Figure 5:
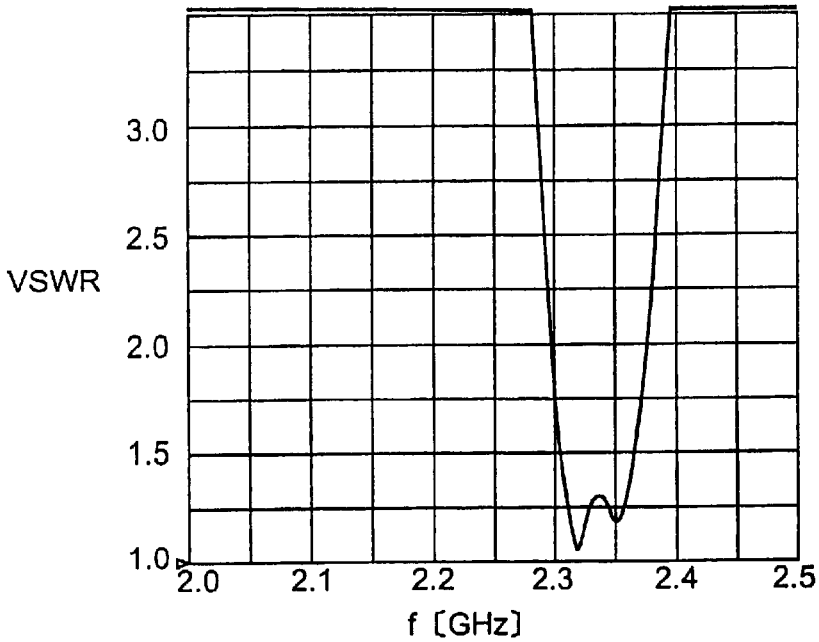
FIG. 5 shows VSWR characteristics of an antenna device according to an embodiment of the present invention.
Figure 6:
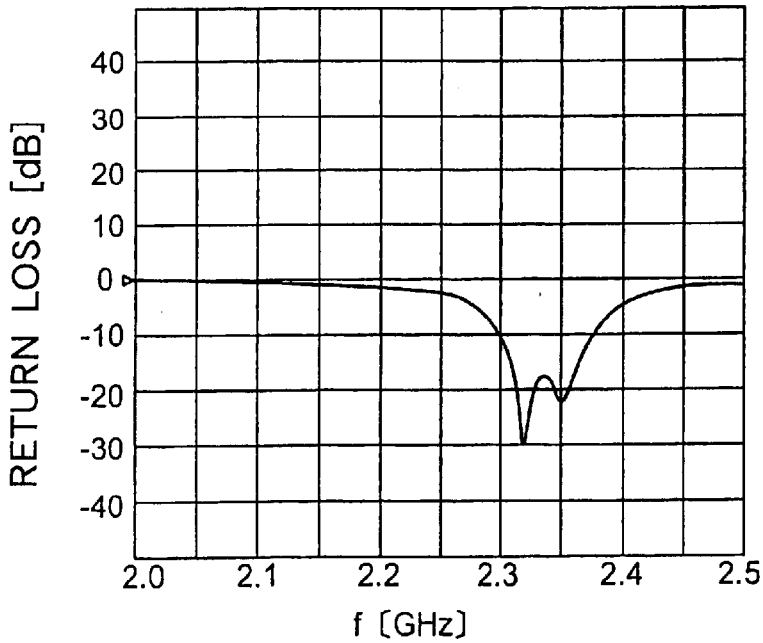
FIG. 6 shows return loss characteristics of an antenna device according to an embodiment of the present invention.
Figure 7:
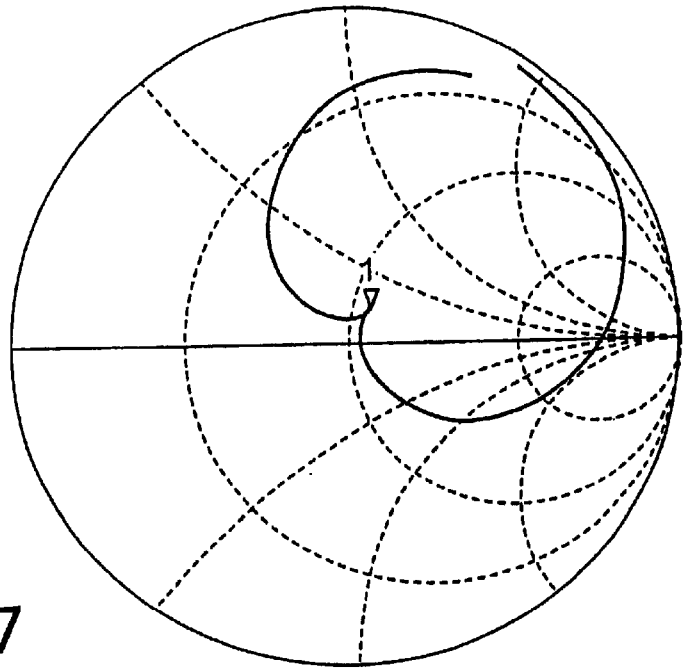
FIG. 7 is a Smith chart for an antenna device according to an embodiment of the present invention.

FIGS. 5 through 7 show an experimental voltage standing-wave ratio (VSWR), a return loss corresponding to the VSWR, and a Smith chart, respectively. Any of the characteristics FIGS. 5 through 7 indicates that an excellent performance is available at approximately 2.34 GHz with an input impedance of 50 Ω.

Figure 1:
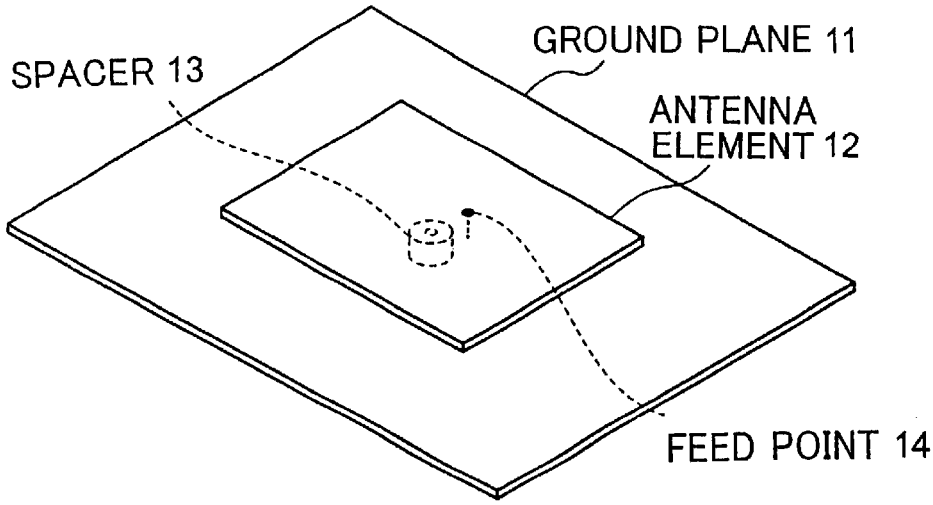
FIG. 1 (PRIOR ART)
FIG. 1 is a perspective view exemplifying a structure of a conventional air patch antenna device.
Figure 2:
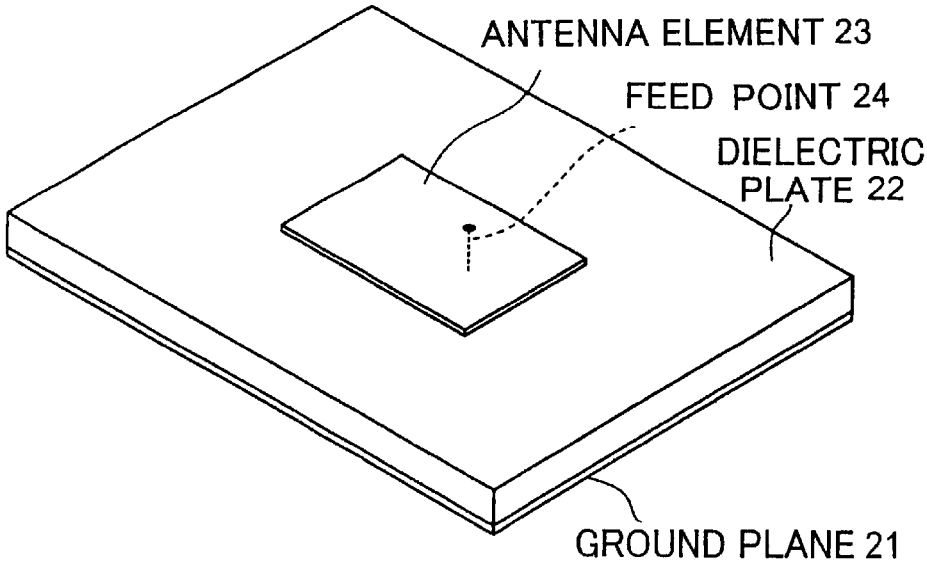
FIG. 2 (PRIOR ART)
FIG. 2 is a perspective view exemplifying a structure of a conventional dielectric patch antenna device.
Figure 8:
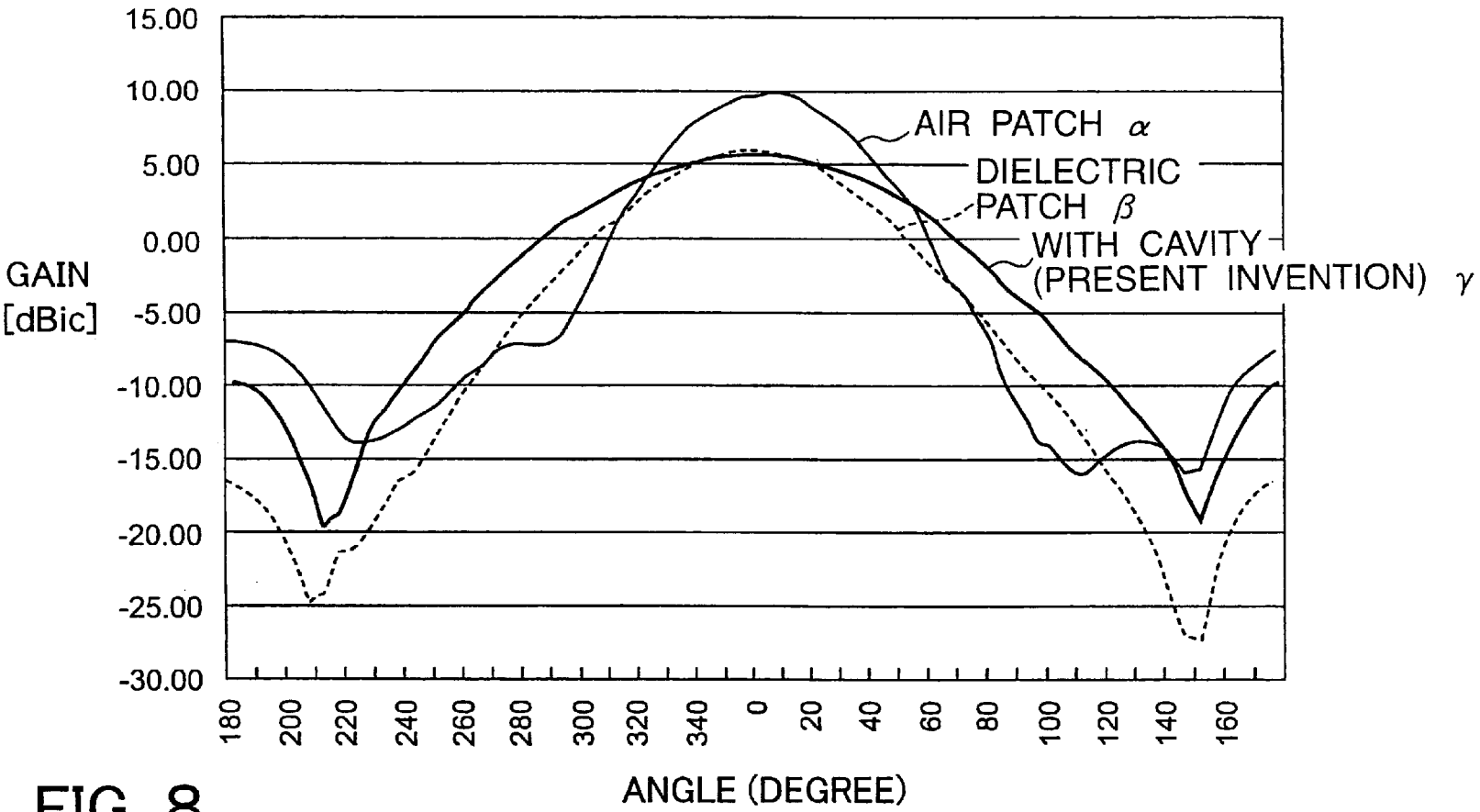
FIG. 8 shows gain characteristics of an antenna device according to an embodiment of the present invention in comparison with conventional antenna devices corresponding to azimuth angles at a horizontal plane.
Figure 9A:
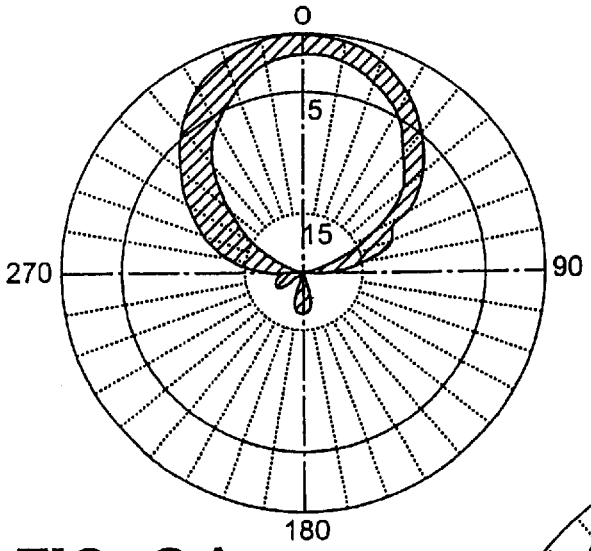
FIGS. 9A through 9C show directivities of an antenna device according to an embodiment of the present invention and conventional antenna devices.
Figure 9B:
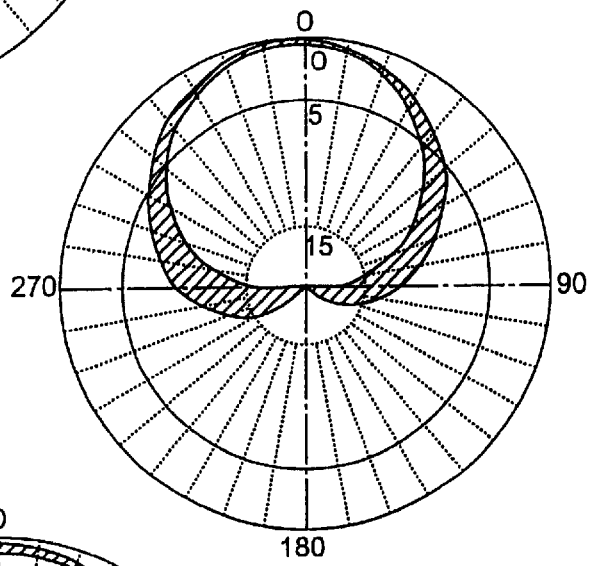
Figure 9C:
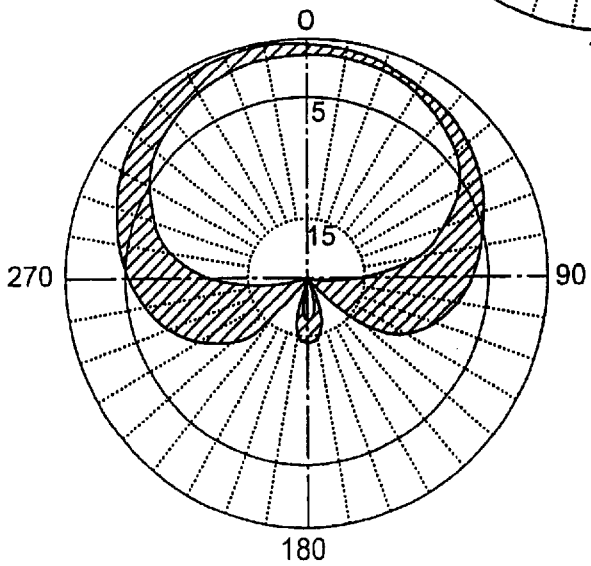

FIGS. 8 through 9C exemplify characteristics of the antenna device according to the embodiment of the present invention in comparison with the air patch antenna device in FIG. 1 and the dielectric patch antenna device in FIG. 2.

FIG. 8 shows gain characteristics corresponding to azimuth angles at a horizontal plane. A characteristic a indicated by a thin line corresponds to the air patch antenna device in FIG. 1. A characteristic β indicated by a broken line corresponds to the dielectric patch antenna device in FIG. 2. A characteristic γ indicated by thick lines corresponds to the antenna device with the cavity 35 in FIGS. 3 and 4 according to this embodiment.

As shown in FIG. 8, the air patch antenna device showing the characteristic α provides a high gain at around azimuth angle 0°, but causes large gain changes corresponding to azimuth angles. The air patch antenna device in FIG. 8 is found to be inappropriate for, especially, an on-vehicle antenna device which always changes antenna device angles according to directions of radio waves received.

The dielectric patch antenna device showing the characteristic β decreases the antenna element size and causes a dielectric loss, decreasing the total gain for the entire antenna device.

By contrast, the antenna device according to this embodiment showing the characteristic γ causes a little change in gains according to azimuth angles and is found to be suited for an antenna device which always changes antenna device angles in accordance with directions of radio waves received.

FIGS. 9A through 9C show directivities of the antenna devices explained in FIG. 8.

FIG. 9A exemplifies a directivity of the air patch antenna device. The directivity is valid only in a front direction and within a high elevation angle range. It is understood that the directive range is very narrow.

FIG. 9B exemplifies a directivity of the dielectric patch antenna device. Compared to the air patch antenna device in FIG. 9A, the dielectric patch antenna device in FIG. 9B increases a characteristic at the azimuth angle and toward a low elevation angle. However, it is understood that the directivity is unsatisfactory.

FIG. 9C exemplifies a directivity of the antenna device with the cavity 35 according to this embodiment. The antenna device in FIG. 9C provides the directivity in a very wide range not only at the azimuth angle on the horizontal plane, but also at elevation angles especially ranging from low to high elevation-angle directions.

As mentioned above, the antenna device structure with the cavity 35 according to this embodiment of the present invention can maintain high electromagnetic field radiation characteristics over a wide elevation angle range from a low elevation-angle direction. It is also possible to provide a sufficiently high total gain for the entire antenna device.

Compared to a quadrifilar helical antenna device, a cross di-pole antenna device, and the like having high efficiency and low elevation-angle radiation characteristics, the antenna device according to this embodiment of the present invention provides the following advantages.

(1) Simplifying a structure of the entire antenna device including a feed structure.

(2) Providing a mechanically solid structure having the rigid cavity for guarding the antenna element with no sharp projections.

(3) Easily manufacturing the antenna device.

(4) Easily thinning the entire antenna device structure.

The antenna device according to the present invention can be easily mass-produced and be suitably mounted on vehicles such as cars.

The above-mentioned embodiment provides an air patch antenna device with the cavity 35. The present invention is not limited thereto.

Figure 10:
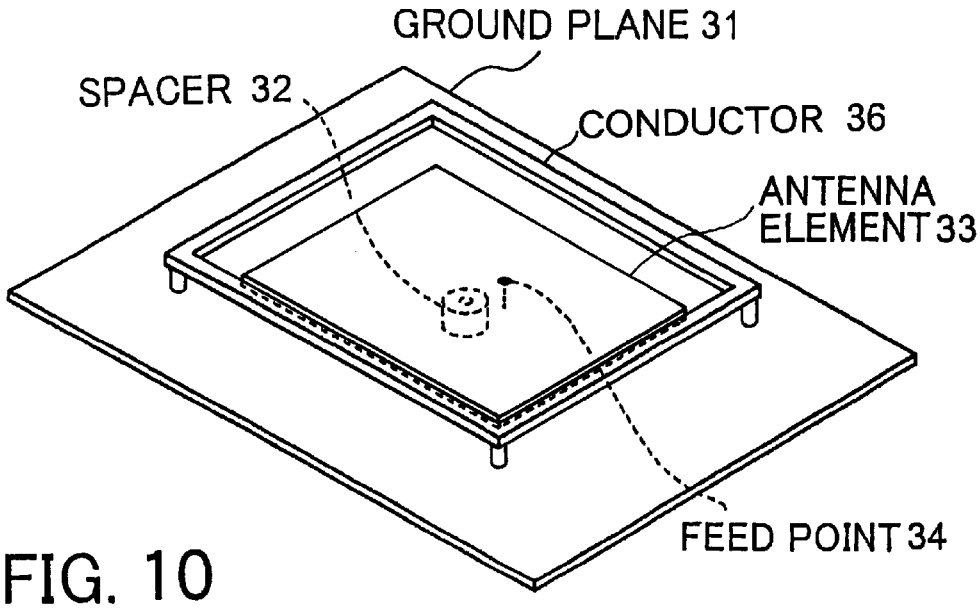
FIG. 10 is a modification of an antenna device according to the present invention.

For example, in the embodiment, an elevation radiation characteristic is improved by providing the cavity, but a rectangular conductor 36 having an opening (or may be a circular conductor, or a linear conductor like a wire etc.) as shown in FIG. 10 may be provided like the cavity 35. That is, any conductor may be used to define an aperture of the antenna. With this configuration, the same advantage can be obtained as the above-mentioned embodiment.

The present invention is not limited to above-mentioned embodiment, and can be achieved in a scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A planar patch antenna device comprising:

a ground plane;

a planar antenna element having a principal plane mounted above said ground plane;

a hollow, air-filled cavity that has a substantially planar opening partially exposing said antenna element, that is placed on said ground plane, and that surrounds said antenna element contactlessly, wherein said opening is of a smaller area than said ground plane, and has the property that for every pair of points on the edge of the opening, a straight line between those two points lies entirely within or on the edge of the opening.

2. The antenna device according to claim 1, wherein said opening has a smaller area than the area of said antenna element.

3. The planar antenna device according to claim 1, wherein said opening is substantially parallel to a principal plane of said antenna element.

4. The planar antenna device according to claim 1, wherein said antenna element is an air patch antenna element mounted above said ground plane and said antenna element and said ground plane are separated by a spacer.

5. The planar antenna device according to claim 1, further comprising a feed point which supplies a power supply to said antenna element.

6. The planar antenna device according to claim 5, wherein said opening has a smaller area than the area of said antenna element.

7. The planar antenna device according to claim 5, wherein said opening is substantially parallel to a principal plane of said antenna element.

8. The planar antenna device according to claim 5, wherein said antenna element is an air patch antenna element mounted above said ground plane and said antenna element and said ground plane are separated by a spacer.

9. The planar antenna device according to claim 1, wherein said opening has a substantially similar shape to said planar antenna element.

10. The planar antenna device according to claim 5, wherein said opening has a substantially similar shape to said planar antenna element.

11. The planar antenna device according to claim 1, wherein said opening is formed such that a circumference of said planar antenna element is not exposed.

12. The planar antenna device according to claim 1, wherein said antenna element has a rectangular shape.

13. The planar antenna device according to claim 1, wherein said opening is shaped like a single rectangle.

14. The planar antenna device according to claim 12, wherein said opening is shaped like a single rectangle.

15. The planar antenna device according to claim 1, wherein said cavity is box-shaped.

16. The planar antenna device according to claim 1, wherein edges of said opening form a polygon.

17. The antenna device according to claim 1, wherein said ground plane is a metal plate.

18. The antenna device according to claim 4, wherein said spacer is in contact with less than half of said antenna element.

19. The antenna device according to claim 18, wherein said spacer is made of synthetic resin.

20. The antenna device according to claim 1, wherein said cavity is made of metal plate.

21. The antenna device according to claim 1, wherein the distance from said ground plane to said opening is less than the diameter of said antenna element.

22. The antenna device according to claim 1, wherein said cavity is made of metal wire.

23. The antenna device according to claim 1, wherein said opening is substantially parallel to said antenna element.

24. A planar antenna device comprising:

a ground plane;

a planar antenna element having a principal plane mounted above said ground plane; and a conductor placed substantially parallel to a principal plane of said antenna element and having an opening at substantially a center thereof, said opening having a smaller maximum diameter than the maximum diameter of said antenna element and being at a pre-determined positive distance from said antenna element, wherein space between said opening and said antenna element is at least partially air-filled.

25. The planar antenna device according to claim 24, wherein said opening is formed such that a circumference of said planar antenna element is not exposed.

26. The planar antenna device according to claim 24, wherein said antenna element has a rectangular shape.

27. The planar antenna device according to claim 24, wherein said opening is shaped like a single rectangle.

28. The planar antenna device according to claim 24, wherein said opening has a circular shape.

29. The planar antenna device according to claim 26, wherein said opening is shaped like a single rectangle.

30. The planar antenna device according to claim 24, wherein said conductor is box-shaped.

31. The planar antenna device according to claim 24, wherein edges of said opening form a polygon.

32. A planar antenna device comprising:

a ground plane;

a planar antenna element having a principal plane mounted above said ground plane; and a conductor placed substantially parallel to a principal plane of said antenna element and having an opening at substantially a center thereof, said opening having a smaller width than the width of said antenna element and being at a pre-determined positive distance from said antenna element, wherein space between said opening and said antenna element is at least partially air-filled.

33. An on-vehicle planar patch antenna device for receiving satellite broadcasting, comprising:

a ground plane;

a planar air patch antenna element having a principal plane mounted above said ground plane and separated from said ground plane by a spacer thicker than said antenna element;

a hollow, air-filled cavity that has a substantially planar opening partially exposing said antenna element, that is placed on said ground plane, and that surrounds said antenna element contactlessly, wherein said opening is substantially parallel to a principal plane of said antenna element, has a smaller area than said antenna element, and has the property that for every pair of points on the edge of the opening, a straight line between those two points lies entirely within or on the edge of the opening.

34. A planar antenna device comprising:

a ground plane;

a planar antenna element that is on the ground plane and has a principal plane above the ground plane; and a hollow, air-filled cavity that is substantially planar, partially exposes the antenna element, and is smaller in area than the ground plane; and an edge that defines the opening on the hollow, air-filled cavity, wherein every pair of points on the edge is such that an imaginary straight line joining that pair of points lies entirely within or on the edge defining the opening.

35. A planar antenna device comprising:

a ground plane;

a planar antenna element that is on the ground plane and has a principal plane above the ground plane; and a hollow, air-filled cavity that is substantially planar, partially exposes the antenna element, and is smaller in area than the ground plane; and an edge that defines the opening on the hollow, air-filled cavity, wherein there are no two points on the edge that can be connected by a straight line that has a sub-part that lies outside the opening.

* * * * *